United States Patent [19]

Drinkard

[11] 4,026,360

[45] May 31, 1977

[54] HYDROTHERMALLY FORMING A FLOW BARRIER IN A LEACHED SUBTERRANEAN OIL SHALE FORMATION

[75] Inventor: Gary Drinkard, Houston, Tex.

[73] Assignee: Shell Oil Company, Houston, Tex.

[22] Filed: Aug. 12, 1976

[21] Appl. No.: 713,759

[52] U.S. Cl. ..... 166/272; 166/261

[51] Int. Cl.[2] ..... E21B 43/24

[58] Field of Search ..... 166/272, 256, 261, 252, 166/253, 271, 303, 307, 245

[56] References Cited

UNITED STATES PATENTS

| | | | |
|---|---|---|---|
| 2,813,583 | 11/1957 | Marx et al. | 166/272 |
| 2,899,186 | 8/1959 | Crawford | 166/245 |
| 3,331,438 | 7/1967 | Slusser | 166/261 |
| 3,346,044 | 10/1967 | Slusser | 166/256 |
| 3,410,345 | 11/1968 | Fradkin | 166/272 X |
| 3,563,312 | 2/1971 | Zwicky | 166/272 X |
| 3,727,686 | 4/1973 | Prats et al. | 166/261 |
| 3,739,851 | 6/1973 | Beard | 166/272 X |
| 3,741,306 | 6/1973 | Papadopoulos et al. | 166/272 X |
| 3,759,328 | 9/1973 | Veber et al. | 166/272 X |
| 3,804,172 | 4/1974 | Closmann et al. | 166/272 |

*Primary Examiner*—Stephen J. Novosad

[57] ABSTRACT

Shale oil can be produced from a naturally fractured and leached subterranean oil shale formation by reacting the formation components with a hot aqueous alkaline liquid to form and distribute clay-like materials which can be water-swollen to form a flow barrier along or around a selected portion of the oil shale formation. Such flow barriers can guide or confine fluids that are injected and produced to recover shale oil.

5 Claims, No Drawings

HYDROTHERMALLY FORMING A FLOW BARRIER IN A LEACHED SUBTERRANEAN OIL SHALE FORMATION

BACKGROUND OF THE INVENTION

This invention relates to producing shale oil and related materials from a naturally fractured and leached portion of a subterranean oil shale formation of the type encountered in the Piceance Creek Basin in Colorado.

Numerous portions of subterranean oil shale formations of the above type contain substantially impermeable kerogen-containing minerals mixed with water-soluble minerals or heat-sensitive minerals which can be thermally converted to water-soluble materials. A series of patents typified by the T. N. Beard, A. M. Papadopoulos and R. C. Ueber U.S. Pat. Nos. 3,739,851; 3,741,306; 3,753,594; 3,759,328 and 3,759,574 describe processes for recovering shale oil from portions of subterranean oil shale formations which are substantially free of interconnected flow paths. However, where an oil shale formation containing such mixtures of components has been naturally fractured and/or leached, the impermeable kerogen-containing components tend to be surrounded by a network of interconnected flow paths. In such a flow path-permeated formation a hot fluid may spread throughout the flow paths before it transfers enough heat to the Kerogen-containing components to pyrolyze a significant amount of the kerogen.

Various situations or processes have been previously encountered or proposed regarding subterranean earth formations in which hot fluids tend to be too quickly dissipated into a network of flow paths. For example, U.S. Pat. No. 2,813,583 describes a fortuitous situation in which the confining of such fluids is aided by nature. The patent describes a hot fluid drive process for recovering oil from the Sprayberry formation in Texas, which formation comprises a laminated shale, limestone, dolomite and sandstone section that contains a network of interconnected fractures through which a hot fluid might be expected to leak into the non-productive layers. But, at least in some such instances, those non-productive layers contain water-swellable clays which tend to swell and plug the fractures. U.S. Pat. No. 2,899,186 describes a process for recovering hydrocarbons by an in situ combustion within a carbonaceous formation having an exposed face or outcrop. A flow-confining barrier is formed along the exposed face by forwardly advancing a combustion front from a line of wells paralleling the face. Reverse combustion is then used to advance the front toward the interior of the formation while allowing a cooling of hot tar to form a flow barrier along the exposed face. U.S. Pat. No. 3,346,044 describes a hot fluid soak process, i.e., injecting hot fluid and then producing fluid from the same well, in an oil shale formation containing a fluid-dissipating network of flow channels. A combustion front is forwardly advanced radially outward, through the flow channels, so that a flow barrier is formed by the subsequent cooling of the heated and displaced oil. The hot fluid soak process is then conducted within the barrier-surrounded portion of the oil shale formation.

Copending U.S. patent application Ser. No. 642,821 filed Dec. 22, 1975 describes a process for producing shale oil from a subterranean oil shale of the type encountered in the Piceance Creek Basin. The oil shale formation components are reacted with hot aqueous alkaline liquid to disaggregate the oil shale matrix, convert at least some kerogen to fluid bitumen and shale oil, and dissolve at least some water-soluble mineral components exposed in or along the walls of an opening or cavity within an otherwise impermeable portion of the oil shale formation. Such a fluid is circulated into and out of the cavity in a manner causing the cavity to enlarge as the shale oil and bitumen are produced. The patent application mentions that such hydrothermal changes in the inorganic portions of the oil shale component can produce a clay or clay-like material.

SUMMARY OF THE INVENTION

The present invention relates to producing shale oil from a subterranean oil shale formation which has a composition at least similar to those encountered in the Piceance Creek Basin in Colorado and contains an interconnected network of relatively permeable channels formed by the natural fracturing or leaching of the formation. At least one pair of wells is opened into the formation and is operated so that fluid flows between them along a selected path within the oil shale formation. The composition, pressure and temperature of the so-flowed fluid is adjusted (a) to cause the oil shale to be contacted by a relatively hot aqueous alkaline liquid that hydrothermally converts oil shale mineral components to particles of water-swellable clay-like material that are dispersed along the flow path, and (b) to subsequently contact the so-dispersed particles with a relatively electrolyte-free aqueous liquid that swells the clay-like materials and reduces the permeability of the earth formations within the flow path. Shale oil is then produced by circulating fluid into and out of a portion of the oil shale formation which is bounded by a flow-confining barrier formed by at least one such path of reduced permeability.

DESCRIPTION OF THE INVENTION

The present invention is, at least in part, premised on a discovery that the hydrothermal production of clay-like water-swellable materials (when the specified type of oil shale formation is contacted by a stream of relatively hot aqueous alkaline liquid flowing within the oil shale formation): (a) is such that fine particles of the clay-like materials become dispersed substantially throughout the flow path; (b) causes such clay-like particles to remain small so that the flow path remains permeable while the dissolved electrolyte content of the liquid flowing through the path remains substantially as high as that of the aqueous alkaline liquid that formed the particles; and (c) causes the clay-like particles to swell and reduce the permeability of the flow path when the dissolved electrolyte concentration of the aqueous liquid flowing through the path is reduced relative to that of the liquid which formed the clay-like particles.

As used herein "oil shale" refers to an aggregation of inorganic solids and a predominately hydrocarbon-solvent-insoluble organic-solid material known as "kerogen". "Bitumen" refers to hydrocarbon-solvent-soluble organic material that may be initially present in an oil shale or may be formed by a thermal conversion or pyrolysis of kerogen. "Shale oil" refers to gaseous and/or liquid hydrocarbon materials (which may contain trace amounts of nitrogen, sulfur, oxygen, or the like) that can be obtained by distilling or pyrolyzing or extracting organic materials from an oil shale. "Water-soluble inorganic mineral" refers to halites or carbonates, such as the alkali metal chlorides, bicarbonates or carbonates, which compounds or minerals exhibit a significant solubility (e.g., at least about 10 grams per 100 grams of solvent) in generally neutral aqueous liquids (e.g., those having a pH of from about 5 to 8) and/or heat-sensitive compounds or minerals, such as nahcolite, dawsonite, trona, or the like, which are naturally water-soluble or are thermally converted at relatively mild temperatures (e.g., 500° to 700° F) to materials which are water soluble. The term "water-soluble-mineral-containing subterranean oil shale" refers to an oil shale that contains or is mixed with at least one water-soluble inorganic mineral, in the form of lenses, layers, nodules, finely-divided dispersed particles, or the like. A "cavern" or "cavity" (within an oil shale formation) refers to a relatively solids-free opening or void in which the solids content is less than about 60% (preferably less than about 50%) and substantially all of the solids are fluid-surrounded particles which are substantially free of the lithostatic pressure caused by the weight of the overlying rocks.

The oil shale formation to which the present process is applied can be substantially any having a chemical composition at least similar to those encountered in the Piceance Creek Basin of Colorado and containing a naturally occurring network of interconnected relatively permeable channels. Particularly suitable oil shale formations comprise the Parachute Creek members of the Piceance Creek Basin which are sandwiched between overlying and underlying formations that are relatively impermeable. Such formations usually contain minerals having the elements silicon, calcium, magnesium and aluminum, usually in the form of quartz, feldspar, calcite, analcite or dawsonite.

In the present process, the wells which are opened into fluid communication with the oil shale formation to be treated can be drilled, completed and equipped in numerous ways. The fluid communication can be established by substantially any of the conventional procedures for providing fluid communication between conduits within the well boreholes and the surrounding earth formation over intervals of significant vertical extent.

The arranging and operating of wells to provide flows of fluid along selected paths which are to be converted to flow-restricting barriers can be connected in numerous ways known to those skilled in the art. For example, the wells and well patterns can be arranged as described in the R. E. Tenny U.S. Pat. No. 3,318,380, which is directed to forming a fluid storage reservoir within a permeable subterranean earth formation. Where the oil recovery process involves a gas-heated pyrolysis productive of predominately gaseous products and the section of the oil shale formation to be treated underlies a relatively impermeable formation, the flow-confining barriers formed in accordance with the present process need only to extend from the overlying impermeable layer to a selected depth below that layer.

The fluid flowed between pairs of wells of selected paths which are to be converted to flow restricting barriers can be substantially any relatively soft aqueous liquid. Such fluids preferably have a ionic content of not more than about 7500 parts per million. The injection pressures are preferably kept low enough to avoid forming new fractures or enlarging existing fractures around the injection wells. The pressures with the production wells are preferably kept as low as feasible to enhance the channeling of the circulated fluid into a relatively narrow vertical ribbon-shaped flow path.

The circulation of hot aqueous alkaline liquid through the selected flow paths can be initiated by increasing the temperature and alkalinity of the aqueous liquid being injected. Alternatively, the injection of a substantially ambient temperature, substantially neutral aqueous liquid can be interrupted by injecting one or more batches of hot aqueous alkaline liquid. In general, the hot aqueous alkaline liquid should have temperatures of from about 250° to 650° F and a pH of from about 7.5 to 11.5. Where desirable, produced portions of the hot alkaline liquid can be adjusted in composition and temperature, to the extent desired, and recycled. The duration of the circulating of hot aqueous alkaline liquid can vary with variations in the composition of the subterranean oil shale formation and in the extent of permeability reduction to be obtained in converting the selected flow path to a flow-confining barrier.

After circulating sufficient hot aqueous alkaline fluid to form and disperse a selected amount of particles of water-soluble clay-like materials, the composition of the circulating liquid is preferably altered to that of a relatively electrolyte-free aqueous liquid. In general, the relatively electrolyte-free aqueous liquid should have a total dissolved solids content of not more than about 15,000 and preferably not more than about 7,500 parts per million. The temperature of at least the first-injected portions of such a liquid is preferably substantially equal to that of the last-circulated portions of the hot aqueous alkaline liquid. The electrolyte-free liquid is preferably initially injected at substantially the same rate and pressure applied to the last-circulated portions of the hot aqueous alkaline liquid. As the particles of clay-like materials become swollen by the electrolyte-free liquid the permeability of the flow path decreases and the rate of injection should be allowed to decrease, at least to the extent required to avoid fracturing, the formation.

After forming at least one flow-confining barrier along or around a selected region from which to produce shale oil, the shale oil can be recovered by substantially any process of injecting fluid capable of converting kerogen to shale oil and producing a shale oil-containing fluid from that region. The injected fluid is preferably a combustion-supporting mixture which is heated to an oil shale pyrolyzing temperature by an underground combustion or steam or a mixture of steam and gases which are relatively insoluble in the components of an oil shale or the liquid or solid products of pyrolyzing an oil shale.

Samples of generally sand-size particles of a Green River oil shale formation were heated at the temperatures indicated in Table I under aqueous-liquid solutions at the indicated compositions. The fluid pressures were about the minimum needed to keep substantially all of the aqueous fluid liquid. Where the fluid status was "static" the fluids were kept quiescent and where the status was "flow" the aqueous liquid phase was changed by displacement of equal portions of solutions of the same initial concentration during the test.

Table II shows the results of the above tests on the crystalline components of the oil shale samples, as indicated by an x-ray diffraction analysis. The mineral components are indicated in percentages by weight.

The concentration of "clay" refers to the clay-like mineral material that was produced during the treatment. Typical samples of the untreated "raw shale" contained only the indicated proportions of feldspar and calcite along with 15% quartz, 35% dolomite, 17.5% nahcolite, and 17.5% dawsonite. Thus, it is apparent that significant proportions of clay-like minerals were formed by hydrothermal conversion of the mineral components during the interaction between the oil shale samples and the hot aqueous alkaline liquids.

Table I

| Run No. | Temperature (° F) | Duration t (days) | Fluid Description | Fluid Status |
|---|---|---|---|---|
| 4-A | 554 | 35 | Aq. phase: 5% $Na_2CO_3$ | Static |
| 4-B | 554 | 35 | Aq. phase: 5% $Na_2CO_3$ | Flow |
| 4-C | 554 | 49 | Aq. phase: 5% $Na_2CO_3$ | Static |
| 4-D | 554 | 49 | Aq. phase: 5% $Na_2CO_3$ | Flow |
| 6-1 | 617 | 20 | Aq. phase: 5% $Na_2CO_3$ | Static |
| 6-2 | 617 | 20 | Aq. phase: 5% $Na_2CO_3$ | Flow |
| 6-3 | 617 | 22 | Aq. phase: 5% $Na_2CO_3$ | Static |
| 6-4 | 617 | 22 | Aq. phase: 5% $Na_2CO_3$ | Flow |
| 7-1 | 482 | 5 | Aq. phase: 5% $Na_2CO_3$ | Static |
| 7-2 | 482 | 10 | Aq. phase: 5% $Na_2CO_3$ | Static |
| 7-3 | 482 | 10 | Aq. phase: 5% NaOH | Static |
| 7-4 | 482 | 30 | Aq. phase 5% $Na_2CO_3$ | Static |
| 8-A | 482 | 14 | Aq. phase: 5% $Na_2CO_3$ | Static |
| 8-B | 482 | 24 | Aq. phase: 5% $Na_2CO_3$ | Static |

Table II

| Run No. | Feldspar | Calcite | Analcite | "Clay" |
|---|---|---|---|---|
| Raw Shale | 10 | 20 | — | — |
| 4-A | 30 | 20 | 20 | 30 |
| 4-B | 20 | 20 | 30 | 30 |
| 4-C | 25 | 25 | 10 | 40 |
| 4-D | 10 | 20 | 50 | 20 |
| 6-1 | 20 | 20 | 25 | 35 |
| 6-2 | 25 | 20 | 15 | 40 |
| 6-3 | 25 | 30 | 15 | 30 |
| 6-4 | 10 | 35 | 30 | 25 |
| 7-1 | 10 | 45 | 25 | 20 |
| 7-2 | 10 | 45 | 25 | 20 |
| 7-3 | 15 | 35 | 20 | 30 |
| 7-4 | 15 | 35 | 20 | 30 |
| 8-A | 10 | 45 | 25 | 20 |
| 8-B | 10 | 45 | 25 | 20 |

To illustrate the permeability effects of such clay-like materials a laboratory experiment was conducted in which a sample of Green River oil shale, pretreated in an aqueous sodium-alkaline solution at approximately 600° F for a time sufficient to form clay-like materials, was tested for permeability to brine and water.

The so-treated samples were made into "reconstituted" cores for use in a permeability apparatus by lightly tamping it into a split mold containing a cylindrical opening 1 inch in diameter by about 2½ inches long. The core thus produced was then frozen, removed from the mold, and placed in a rubber-sleeve Hassler-type holder. A thin wafer of porous Alundum ($K > 10$ darcies) was used to confine the ends of the core. Isostatic pressure of 35 psi was applied to the sample and the core was saturated with a synthetic brine containing 25,000 ppm NaCl. Permeability to a flowing brine of the same high electrolyte composition was measured over a three-hour period. Permeability decreased from about 66 millidarcies (md) to a stable level of about 28 md during the flowing through the core of about 26 to 36 ccs of the brine.

After this phase of the test, the flooding liquid was changed to fresh water and additional permeability measurements made for approximately two hours. During this time permeability decreased from about 28 to less than 4 md during the flowing through the core of about 35 ccs of the fresh water. This behavior illustrates the permeability control achievable by conversion of shale using alkaline solutions followed by treatment with low salinity water.

Typical results of dispersive x-ray analysis of similarly treated oil shale samples have shown the major effect of such a conversion to be the formation of clay-like material resembling montmorillinite. The permeability decreases observed in the above tests are believed to arise from swelling of this material in the presence of fresh water in the same way that natural montmorillinite swells and closes off permeability.

What is claimed is:

1. A process for producing shale oil from a subterranean oil shale which comprises:

opening at least one pair of wells into fluid communication with a subterranean oil shale formation which has a composition at least substantially equivalent to that of the oil shale formations encountered in the Piceance Creek Basin to Colorado and which contains a network of relatively permeable interconnected flow channels formed by a natural fracturing or leaching of the oil shale formation;

operating the wells so that fluid flows between at least one pair of wells along a selected path within the oil shale formation;

adjusting the composition, pressure and temperature of the so-flowed fluid so that oil shale formation components within the selected path are contacted by a relatively hot aqueous alkaline liquid which hydrothermally converts them to particles of clay-like material that are distributed along the flow path;

adjusting the composition, pressure and temperature of the so-flowed fluid so that the particles of clay-like materials distributed along the flow path are contacted by an aqueous liquid which is relatively free of electrolytes and is capable of swelling the clay-like particles so that the permeability of the earth formations within the flow path is reduced; and producing shale oil by injecting fluid capable of pyrolyzing oil shale into a portion of the oil shale formation which is bounded by a flow-confining barrier formed by at least one so-plugged selected path of fluid flow and producing shale oil-containing fluid from that portion of the oil shale formation.

2. The process of claim 1 in which the portion of the oil shale formation into which wells are opened is located between relatively impermeable overlying and underlying formations; and a plurality of pairs of wells are arranged and operated within that portion of the oil shale formation to form a substantially continuous ring of flow paths which extends vertically substantially from the overlying to the underlying impermeable formation and substantially completely surrounds a selected area from which shale oil is to be recovered.

3. The process of claim 1 in which the hot aqueous alkaline liquid has a temperature of from about 250°–650° F and a pH of from about 7.5–11.5.

4. The process of claim 1 in which the hot aqueous alkaline liquid is one in which the pH-increasing components are predominately alkali metal carbonate compounds.

5. The process of claim 1 in which the relatively electrolyte free aqueous liquid contains no more than about 15,000 parts per million total dissolved solids.

* * * * *